United States Patent [19]

Dorn et al.

[11] 4,429,635

[45] Feb. 7, 1984

[54] MINE, ESPECIALLY ANTITANK MINE

[75] Inventors: Wolfgang Dorn, Niederkassel-Lulsdorf; Fritz Elsner, Troisdorf-Sieglar; Klaus Fischer, Troisdorf; Heinz Kroschel, Troisdorf-Sieglar, all of Fed. Rep. of Germany

[73] Assignee: Dynamit Nobel Aktiengesellschaft, Troisdorf, Fed. Rep. of Germany

[21] Appl. No.: 308,121

[22] Filed: Oct. 2, 1981

[30] Foreign Application Priority Data

Oct. 4, 1980 [DE] Fed. Rep. of Germany ..... 3037607

[51] Int. Cl.[3] ..... F42B 23/04

[52] U.S. Cl. ..... 102/401

[58] Field of Search ..... 102/401, 426

[56] References Cited

U.S. PATENT DOCUMENTS 4,213,391 7/1980 Drimmer ..... 102/401

*Primary Examiner*—Charles T. Jordan

*Attorney, Agent, or Firm*—Antonelli, Terry & Wands

[57] ABSTRACT

A mine, especially an antitank mine, that can be laid on the ground surface by being dropped from the air and that impinges on the ground in a preferred impact direction includes a detonator and an explosive charge located in a housing. The housing is subdivided into an operational part containing the detonator and into an active part containing the explosive. Both the active and operational parts are coupled together by a shape-mating connection. The shape-mating connection is severed when a predetermined impact load on said mine has been exceeded and at this time the active part is separated from the operational part by the impact shock.

3 Claims, 1 Drawing Figure

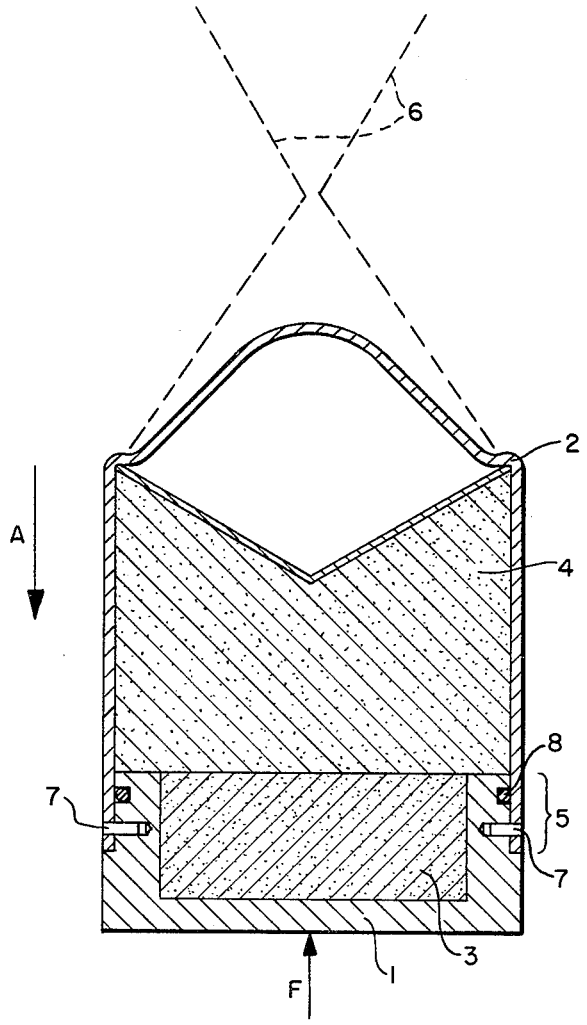
6
2
A
4
8
7
5
7
3
1
F

MINE, ESPECIALLY ANTITANK MINE

The invention relates to an antitank mine having a detonator and an explosive charge in a housing which can be dropped from the air and which impinges on the ground in a controlled impact direction.

It is known to lay mines from the air in order to combat tanks, in particular, by ejecting the mines as a secondary ammunition from a great variety of laying systems, for example rocket warheads, over the target area. By this kind of laying "surface-laid" mine fields are produced.

The distribution of the mines on the ground is dependent on the functional operating cycles of the various laying systems, on the primary and secondary ballistic data, as well as on the prevailing environmental conditions. The coordinates of the individual mines in the terrain are accordingly unknown. Although the mines are surface-laid, their recognizability is very low, due to camouflaging methods such as camouflage painting, rough surface, etc., and due to the cover of vegetation on the terrain.

Therefore, a picking up of the mines or a controlled clearing to make way for one's own troop movements is practically impossible. This can be done only by providing defined operative periods, i.e. dwell periods, for the mines with subsequent self-destruction thereof, set, for example, during or before the laying step. However, the functional reliability of this self-destruction feature must meet high demands so that one's own troops can cross the terrain without danger after the operative period has expired.

The stresses to which the mine is subjected during laying can be defined with relative accuracy, except for the impact load upon hitting the ground. Thus, the stresses exerted on the mine and thus also on the mine detonator by the firing step, vibrations during airborne condition, ejection from the laying system, etc., but also by ambient conditions, such as temperature, shock, transportation, and storage, can be extensively simulated by appropriate tests, and the mine can be correspondingly designed, so that it withstands these stresses satisfactorily.

In contrast thereto, the stresses incurred when impacting on the ground are dependent on many parameters which cannot all be determined with respect to kind and size. Such stresses are dependent, inter alia, on the impact velocity and the angle of impact, the type of terrain, and character of the ground or soil, and/or the damping characteristic of the bottom of the mine. While the impact velocity and the angle of impact can be defined by way of stabilizing means such as a parachute, for example, so that even under unfavorable environmental conditions an optimum dropping speed and distribution of the mines can be obtained, the varying types of terrain will always give rise to impact stresses leading to damage to the mine detonator. Thus, it is possible when the mine hits concrete (a road) or natural rock, for example, that a disturbance occurs in the program sequence of the mine detonator, and the self-destruction of the mine is altered to an indefinite period.

The invention is based on the object of constructing a mine of the type which can be laid on the ground surface by being dropped from the air and which impinges on the ground in a preferred impact direction in such a way that a faulty behavior of the mine, such as, for example, the exceeding of the operative time due to excessive stress during ground impact is safely avoided.

This object has been attained according to the invention by providing a mine, especially an antitank mine which is characterized in that the housing which contains the detonator and explosive charge is subdivided into an operational part containing the detonator and an active part containing the explosive, with both the operational and the active parts being held together by a shape mating connection which can be severed or separated when predetermined impact has been exceeded. The parting zone between the two parts of the housing lies preferably in an area perpendicularly to the preferred, i.e. the controlled impact direction of the mine since in such a case the impact forces will be fully effective on the shape-mating connection; whereas with an extension of the parting zone obliquely to the impact direction, only a corresponding component of the force becomes effective. The impact direction of the mine, i.e. its orientation in space during ground impact, will preferably be determined by a special stabilizing means, such as a parachute, for example. However, it is also possible for the mine to fly sufficiently stably without additional stabilizers due to its geometry, center of gravity position, etc., so that also in this case one can assume that the mine will impinge on the ground of the terrain practically always with the same surface and also in a more or less predetermined direction.

As has been found surprisingly, the construction of this invention makes sure, in case of a ground impact with unduly high stress, that there is not only a disintegration of the shape-mating connection and thus a mechanical separation between the active part from the operational part, but there is moreover also a spatial separation of these parts, in that the member facing away from the ground is flung away from the other member during impact. This ensures in a very simple way that the mine is rendered inoperative in case of an unduly strong ground impact.

By the separation of the housing according to the invention, the ignition train of the mine is interrupted. The separation can be effected between the primer and the booster, i.e. propagation charge, as well as between the booster charge and the secondary explosive charge arranged thereafter. The detonator, to be arranged in the operational part, thus comprises besides other components at least also the primer of the ignition train, but optionally also the booster charge. This ensures in any event that, after the spatial separation of the operational part of the housing from the active part of the housing, the explosive charge of the active part can no longer be made to detonate.

The two parts of the housing can be coupled in a shape-mating fashion, for example, by threading one part into the other with the aid of an appropriate thread, or by joining the two parts in the manner of a bayonet catch. The solidity of the threaded as well as bayonet coupling is determined so that these couplings are safely disconnected after a predetermined load has been exceeded. However, it is preferred to provide a shape-mating connection of the two housing parts which is characterized in that the active part and the operational part are formed as cylindrical housing elements, one being inserted into the other with a sliding fit along a portion of the lengths of each part and are detachably held together by rivets, pins or the like means. Radial coupling pins are, especially preferred as the detachable means for securing one part to the other part.

The invention is shown in one embodiment in the single FIGURE of the accompanying drawing and will be explained in greater detail with reference thereto in the following description.

The mine, shown schematically in a longitudinal section, comprises the two housing parts 1 and 2. The housing part 1 constitutes the operational part and contains the detonator 3; whereas the housing part 2 forms the active part and encompasses the secondary explosive 4. The parts 1 and 2 are shape-matingly joined in the zone of a coupling site in such a way that, when a predetermined force F is exceeded during ground impact, the shape-mating connection is severed, the active part 2 is flung away, and thus is spatially separated from the operational part 1. This separation of the shape-mating connection by a force acting in the impact direction A is also flawlessly executed if there is practically no play between the housing parts 1 and 2 in the axial direction, i.e. in the impact direction A. The parting area between the two housing parts 1 and 2 extends perpendicularly to the preferred impact direction A, this preferred impact direction being obtained by means of a stabilizer parachute attached to the upper end of the mine, of which only the tethering cords 6 are indicated in dashed lines.

The shock stresses are transmitted in all these cases via the structural parts 1 and 2 of the mine to the detonator 3. Thus, the structural parts are placed, upon ground impact, under a greater load than, for example, the mine detonator. In individual cases wherein the mine impinges with part 1 exactly at an angle of 90° on a planar, rigid surface, an approximately identical shock load may be effective on the mine detonator 3.

The structural parts, by way of which the impact load F is introduced during impact on the ground, are dimensioned so that permanent deformations are possible only above a load causing the separation of the coupling site 5. Consequently, deformations at structural units in the interior of the mine, such as for example, at the mine detonator 3, below this load limit are avoided.

The coupling site 5 is preferably in the form of two cylindrical housing parts 1 and 2 which can be plugged one into the other, these housing parts being mutually fixed in position by way of the radially arranged pins 7. In this connection, the coupling site 5 is adapted constructionally so that after the pins have been mounted, a force-derived coupling is established up to the predetermined load limit. The housing parts 1 and 2 are inserted one into the other at the coupling site 5 in a sliding fit and are secured in the insertion direction by the pins 7. The dimension, type of structure, and number of pins define the load limit during ground impact. The strength characteristics of parts 1 and 2 are determined so that in all instances of a load above the fixed load limit, the separation takes place in the coupling site 5 by shearing off, deformation, pulling, breaking, or other action exerted on the pins 7. The pin bores are suitably fashioned in the housing part 1 as blind holes. The collar of the housing part 1 above the pins 7 is provided with a sealing means 8, suitably fashioned as an O-ring seal. This sealing means ensures the required sealing effect with respect to moisture. Sealing means which are of the adhesive or hardening kind, which can impair the strength properties of the coupling site 5, are to be avoided.

What is claimed is:

1. A mine, especially an antitank mine, which can be laid on the ground surface by being dropped from the air and which impinges on the ground in a preferred impact direction, said mine comprising a detonator and an explosive charge located in a housing, said housing being subdivided into an operational part containing the detonator and into an active part containing the explosive, both the active and operational parts being coupled together by a shape-mating connection, and said shape-mating connection being severed when a predetermined impact load on said mine has been exceeded and thereupon the active part is separated from the operational part by the impact shock.

2. A mine according to claim 1, wherein the active part and the operational part are constructed as cylindrical housing elements one being inserted into the other in a sliding fit along a part of the lengths of each, said elements being coupled together in a shape-mating fashion by detachable means.

3. A mine according to claim 2, wherein the detachable means comprise pins radially arranged around said mine and inserted in pin bores provided in each of the cylindrical housing elements, whereby said pins are broken when the predetermined impact load has been exceeded.

* * * * *